United States Patent [19]

Mueller et al.

[11] Patent Number: 5,069,596

[45] Date of Patent: Dec. 3, 1991

[54] BULK BAG HANDLING AND DISCHARGING APPARATUS

[75] Inventors: Hermann Mueller, Lindenhurst; Timothy J. Hendron, Naperville; David Dawood, Chicago, all of Ill.

[73] Assignee: Lawter International, Inc., Northbrook, Ill.

[21] Appl. No.: 550,409

[22] Filed: Jul. 10, 1990

[51] Int. Cl.[5] ..... B65D 33/38; B57B 7/26; B66F 9/00

[52] U.S. Cl. ..... 414/607; 414/412; 414/608; 222/181

[58] Field of Search ..... 414/403, 607, 608, 412; 222/81, 181; 211/187, 207

[56] References Cited

U.S. PATENT DOCUMENTS

| | | | |
|---|---|---|---|
| 3,961,655 | 6/1976 | Nattrass et al. | 222/181 X |
| 4,113,146 | 9/1978 | Williamson | 222/181 X |
| 4,194,652 | 3/1980 | Williamson et al. | 222/181 X |
| 4,291,812 | 9/1981 | Harmes et al. | 211/207 |
| 4,449,649 | 5/1984 | Flannigan | 222/181 |
| 4,527,716 | 7/1985 | Haas et al. | 414/412 X |
| 4,646,357 | 2/1987 | Nattrass | 222/181 X |
| 4,735,546 | 4/1988 | Conley | 414/607 |
| 4,759,473 | 7/1988 | Derby et al. | 222/181 X |
| 4,883,201 | 11/1989 | Poulton | 222/181 X |
| 4,966,311 | 10/1990 | Taylor | 414/403 X |

FOREIGN PATENT DOCUMENTS

| | | | |
|---|---|---|---|
| 109191 | 5/1988 | European Pat. Off. | 414/608 |
| 3005172 | 8/1980 | Fed. Rep. of Germany | 222/181 |
| 2066220 | 7/1981 | United Kingdom | 414/412 |

*Primary Examiner*—David A. Bucci
*Assistant Examiner*—Robert S. Katz
*Attorney, Agent, or Firm*—Jones, Day, Reavis & Pogue

[57] ABSTRACT

A method and apparatus for handling and discharging bulk bags allowing dosage control is disclosed. A bulk bag is hung from a maneuverable frame with a pair of winches mounted thereon. After opening the bottom of the bag, actuation of the winches tightens a cable looped around the lower portion of the bag to restrict the flow of material out of the opening. A bulk bag specially adapted for the method is also disclosed.

15 Claims, 7 Drawing Sheets

BULK BAG HANDLING AND DISCHARGING APPARATUS

FIELD OF THE INVENTION

The present invention relates in general to methods and apparatus for handling and discharging storage containers of a type known generally in the industry as bulk bags.

BACKGROUND

Bulk bags, also known as semi-bulk containers, are used for the storage and transportation of liquids and dry flowable materials as well as viscous semiliquids such as gels and resins. The bags are typically constructed from high strength woven polyolefin fabric allowing the storage of very dense and heavy materials. Standard bulk bags are either cubically or cylindrically shaped with a volume of approximately 27 cubic feet and typically hold around 2,000 pounds of material. One of the advantages of cubically shaped bulk bags over other types of storage containers such as barrels is that, the bags can be stacked so as to take up a minimum of storage space.

Because of the great weight of bulk bags when they are full, fork lift machines or hoists must be used to carry the bags from place to place as well as hold the bags when the bag contents are to be discharged, typically into a mixing vat or another bag. Most bulk bags are, therefore, designed to be carried with a fork lift and have slings in the upper four corners for that purpose. After maneuvering the fork lift in front of the bulk bag, the tines of the fork lift are raised to a level just above the height of the bag. The fork lift is then advanced forward so that the tines travel over the top of the bag. At the same time, the corner slings must be held so that the tines are inserted therethrough. The bulk bag may then be lifted and carried by the fork lift with the bag hanging by two corner slings on each side looped around one of the two tines of the fork lift. Loading a bulk bag onto a fork lift in the manner described above typically requires three persons, one to drive the fork lift and one on each side of the bag to align the corner slings with the advancing fork lift tines.

Once the bulk bag has been placed under onto the fork lift tines, the bag may be carried to the location where its contents are to be discharged. The bag is then placed by the fork lift directly over the discharge container (e.g., a mixing vat) and the bottom of the bag is opened. In the case of thin liquids, a preformed spout in the bag may be employed which can be opened and closed manually. With more viscous contents, however, the bag opening is typically accomplished by simply cutting the bottom of the bag with a knife in order to create a large enough opening. The bag contents in either case are then allowed to empty into the discharge container due to the force of gravity. In the case of gelled viscous liquids, several minutes may elapse before the bag is completely empty even with a relatively large opening. Heretofore, in the case of very viscous contents, there has been no practical way to discharge anything but the entire contents of a single bulk bag into one particular discharge container. That is, once a bulk bag is opened, there has been no way to seal the bag after a certain amount of contents have been discharged. The weight and viscosity of the gelled semiliquids typically stored in bulk bags make it impossible for the discharge flow to be stopped manually. Thus, users of bulk bags have simply had to adjust their processes so as to accommodate the entire contents of a bulk bag at a one particular discharge container. It would be advantageous, however, if there were to be a way by which bulk bag users could controllably discharge the contents of bulk bags. A plurality of discharge containers could then each receive the partial contents of any one bulk bag.

SUMMARY OF THE INVENTION

The present invention is a method and apparatus for use in the transportation of bulk bags and for controllably discharging the contents therefrom. The apparatus allows a bulk bag to be loaded onto a fork lift via a two person (or even one person) operation. The apparatus also provides a means by which the contents of a bulk bag may be controllably discharged, allowing the partial contents of any one bulk bag to be emptied into a plurality of discharge containers.

The present invention, in its most basic form, comprises a generally horizontally oriented base frame mounted on casters or equivalent means so that it may be maneuvered over a floor surface. Extending upwardly from the base frame is a vertical support frame upon which is slideably mounted a cross-beam. The cross-beam may be locked into one of two positions where its further downward travel along the vertical support frame is prevented, an upper fixed position and a lower fixed position. A mechanical stop at the upper end of the vertical support frame also limits the upper travel of the cross-beam along the vertical support frame thus allowing the apparatus to be lifted by the cross-beam.

The apparatus may be lifted using any convenient means but is specially adapted for lifting by a fork lift machine. In one embodiment, the tines of the fork lift are simply placed underneath the cross-beam and raised, the apparatus being stabilized by its even weight distribution and a flat bottom surface on the cross-beam which contacts the fork lift tines. Alternatively a tine channel may be mounted on the cross-beam for receiving the tines of a fork lift. The tine channel may comprise a single slot for receiving both tines or separate slots for each tine of the fork lift. Another special adaptation which may be employed is a hoist loop mounted on the cross-beam through which may be inserted the hook of a chain or cable hoist. In any case, once the fork lift tines or hoist hook engages the cross-beam, the cross-beam is raised until it reaches the upper mechanical stop of the vertical support frame, at which point further raising of the cross-beam results in the lifting of the entire apparatus.

In order to load a bulk bag onto the apparatus, the apparatus is maneuvered in front of a free-standing bulk bag and advanced forward so that the bulk bag is encircled two way by the base frame. The base frame may be positioned at an elevated height by means of a plurality of vertically extending legs which are mounted on the casters so that the bulk bag may pass underneath the base frame and between two of the legs. Alternatively, the base frame may be mounted directly on the casters close to the ground without the use of vertically extending legs. In that case, the base frame should have an open front allowing the bulk bag to pass through. In either case, the apparatus can be maneuvered to a position where the cross-beam is located directly over the bulk bag. A bag hanger mounted on the cross-beam is provided so that the bag may then be hung therefrom. In one embodiment, the bag hanger mounted on the cross-beam (i.e., either the cross-beam or the tine channel) comprises a plurality of strap hooks for engaging the corner slings of a bulk bag. When the cross-beam is in its lower fixed position, the strap hooks are positioned such that the corner slings of the bulk bag may be simply looped over the strap hooks. In another embodiment, the bag hanger comprises a slideably adjustable center pick-up bracket mounted on the cross-beam (or tine channel) which may be inserted through a fabric tunnel located on the top wall of the bulk bag when the cross-beam is in its lower fixed position. As aforesaid, a fork lift or hoist may then engage and raise the cross-beam, along with the bulk bag hanging therefrom, until the upper mechanical stop of the vertical support frame is reached. Further raising of the cross-beam lifts the entire apparatus and the bulk bag which may then be carried to the desired location for discharge of the bag contents.

After adjusting the locking means so that the cross-beam is in its upper fixed position, the apparatus may then be lowered to the ground storage area. The fork lift or hoist may then position the apparatus such that the bulk bag is hanging directly over the discharge container. With the bag then hanging from the apparatus at an elevated height, the bag contents may be discharged into the discharge container by creating an opening in the bottom of the bag.

The apparatus allows a specified dose of material to be discharged from the bag by means of two winches mounted on the vertical support frame. The winches are positioned on the vertical support frame such that one winch is at each side of the hanging bulk bag and at the same elevation as the lower portion of the bag when the cross-beam is in its upper fixed position. The hanging bulk bag may then be girthed by a winch cable or rope with each free end of the cable then attaching to one of the two winches. Operation of the winches so as to pull the winch cable in opposing directions then cinches the bulk bag.

After an opening is created in the bottom of the bag, further cinching restricts the flow of material out of the bag. When the desired dose of material has been discharged, the bag may be cinched tightly to shut off the flow of material completely.

Without a means for holding the cable in fixed position to the walls of the bag, the weight of the bag contents above and lateral to the cable loop tends to pull the lower end of the bag upwardly. When the bag opening is pulled up out of the cable loop, there is then no way to control the further discharge of the bag contents. It is desirable, therefore, to employ means for either supporting the lateral walls of the bag above the cable loop or for securely holding the winch cable around the bag during the cinching operation. Preferably, however, a sleeve around the lower circumference of the bag receives the cable and holds the winch cable around the bag.

After closing the bottom of the bag in the above-described manner and after adjusting the locking means so that the cross-beam is in its upper fixed position, the apparatus may be lowered to the ground. The apparatus with the bag hanging therefrom may then be rolled away from the discharge container and either temporarily stored or taken to another discharge container.

It is an object of the present invention to provide a method and apparatus for efficiently transporting bulk bags by means of a fork lift or hoist.

It is a further object of the present invention to provide a method and apparatus which allows the contents of the bulk bags to be controllably discharged so that a single bulk bag may be emptied into a plurality of discharged containers.

Other objects, features, and advantages of the invention will become evident in light of the following detailed description considered in conjunction with the referenced drawings of a preferred exemplary embodiment according to the present invention.

DETAILED DESCRIPTION OF THE INVENTION

Figure 1:
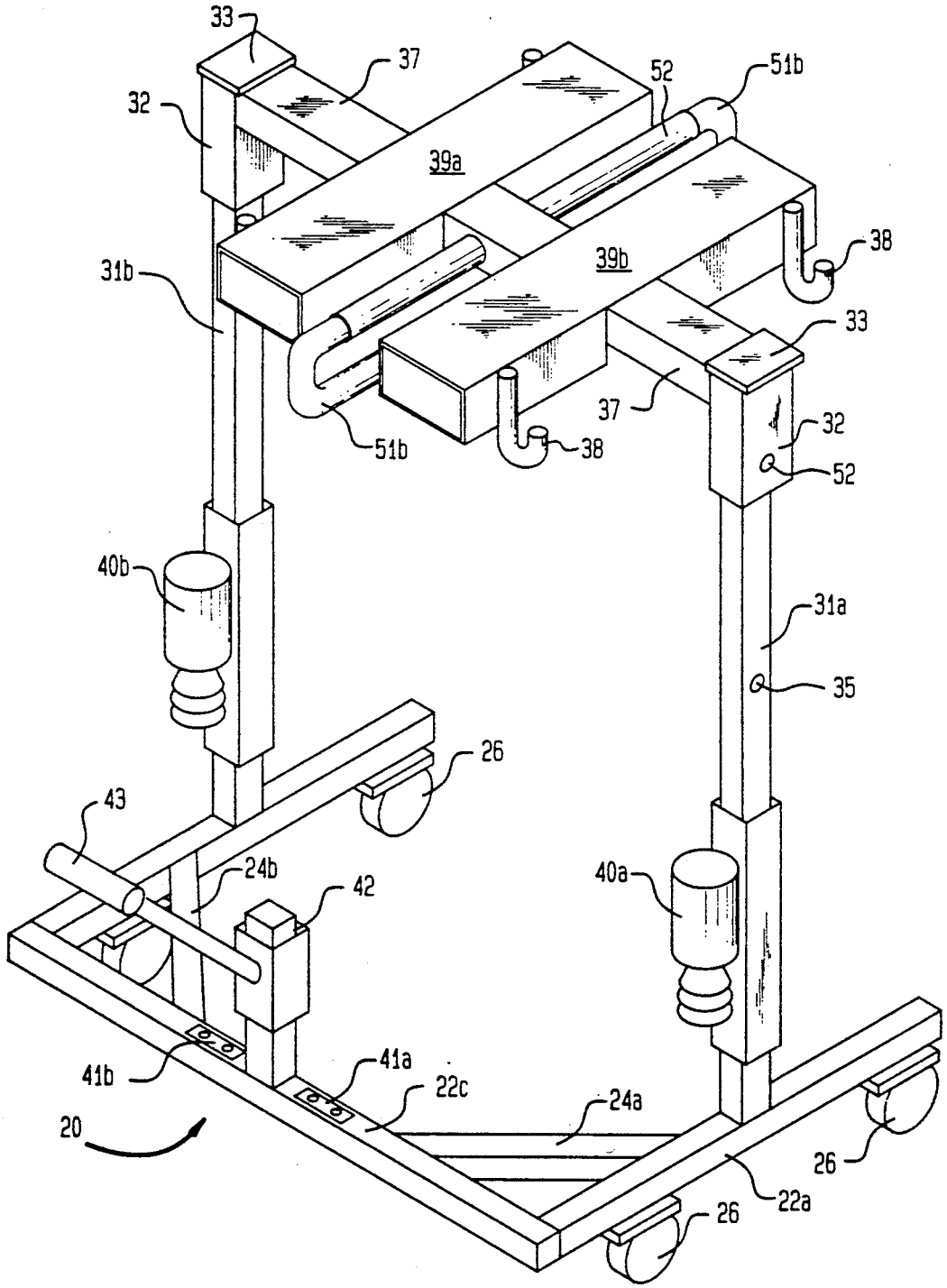
FIG. 1 is a perspective view of the bag handling and discharging apparatus.
Figure 2C:
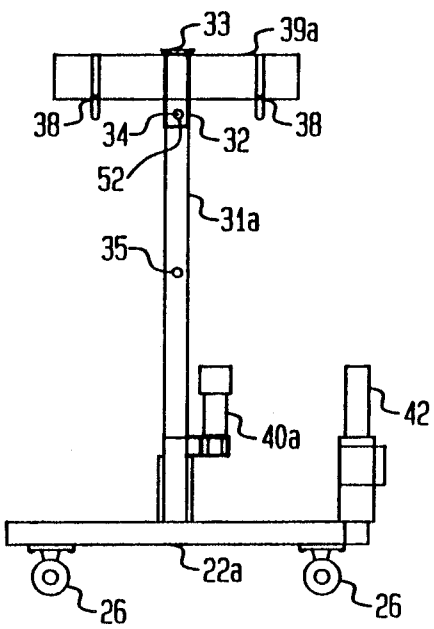
FIG. 2A, 2B, and 2C are top, front, and side views, respectively, of the bag handling and discharge apparatus of the first embodiment.
Figure 2B:
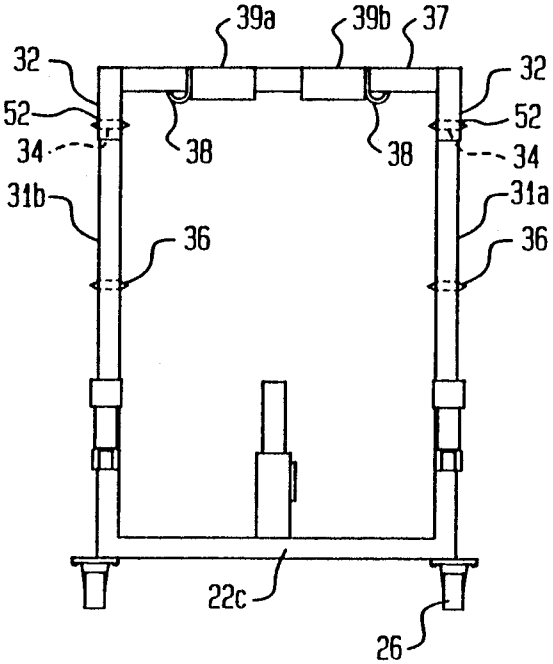
Figure 2A:
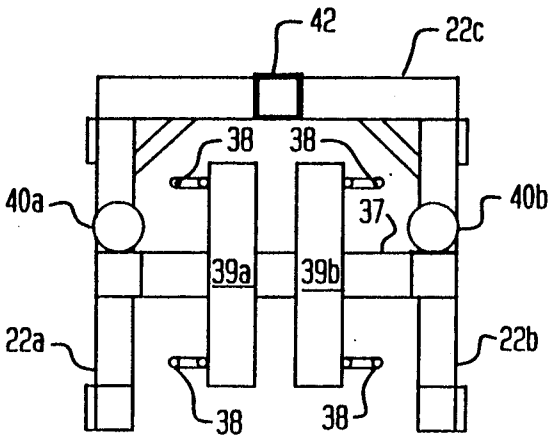

Referring to FIG. 1 and FIGS. 2A through 2C, there is shown a first embodiment of a bag handling and discharging apparatus 20 in accordance with the present invention. A base frame designated 22 is seen to be of generally rectangular construction with an open front. The open front allows a bulk bag to pass through and reside within the frame. The base frame comprises a rear beam 22*c* rigidly connected to side beams 22*a* and 22*b*. Diagonal reinforcing beams 24*a* and 24*b* are rigidly connected to side beams 22*a* and 22*b*, respectively, as well as to rear beam 22*c*, thereby providing added structural stability to the base frame. Mounted on the bottom of the base frame 22 are four casters 26 which enable the apparatus to be easily maneuvered over a floor surface. A push handle 43 mounted on a rear post 42 extending from rear beam 22*c* is also provided.

Extending upwardly from side beams 22*a* and 22*b*, respectively, are vertical support beams 31*a* and 31*b*. A cross-beam 37 is slideably mounted between the support beams 31*a* and 31*b* by means of sleeves 32 at each end of cross-beams 37 through which insert the vertical support beams 31*a* and 31*b*. The cross-beam 37 is thus enabled to travel in a vertical direction. The extent of upward travel of the cross-beam 37 is limited by mechanical stops 33 at the upper ends of vertical support beams 31*a* and 31*b*. In this particular embodiment, mechanical stops 33 are shown as being flanged upper ends of the vertical support beams.

Mechanical stops are also provided to limit the downward vertical travel of the cross-beam 37 and lock the cross-beam 37 in either a fixed upper or a fixed lower position against the pull of gravity. Two separate locking means, an upper and a lower, are provided for this purpose.

The upper locking means maintains the cross-bar in an upper fixed position which coincides with the limit of the cross-beam's upward travel as fixed by mechanical stops 33. In this embodiment, the upper locking means comprises lock pins 36 insertable through holes 34 in each of the vertical support beams 31*a* and 31*b* and holes 52 in the sleeves 32. Holes 52 in the sleeves and holes 34 in the vertical support beams are aligned when the cross-beam 37 is in its upper fixed position. The lower locking means in this embodiment is exactly the same, with holes 35 in the vertical support beams being aligned with holes 52 in the sleeves 32 when the cross-beam 37 is in its lower fixed position. Alternatively, the lower locking means could consist of outwardly extending projections from the vertical support beams, similar to flanges 33.

Mounted in the mid-portion of cross-bar 37 is a tine channel 39 for receiving the tines of a forklift. In the this embodiment, tine channel 39 comprises a pair of rectangular tubes 39*a* and 39*b*. When the tines of a forklift are inserted therethrough, the forklift may raise the cross-beam 37 and thereby also raise the entire apparatus due to mechanical stops 33.

Figure 3:
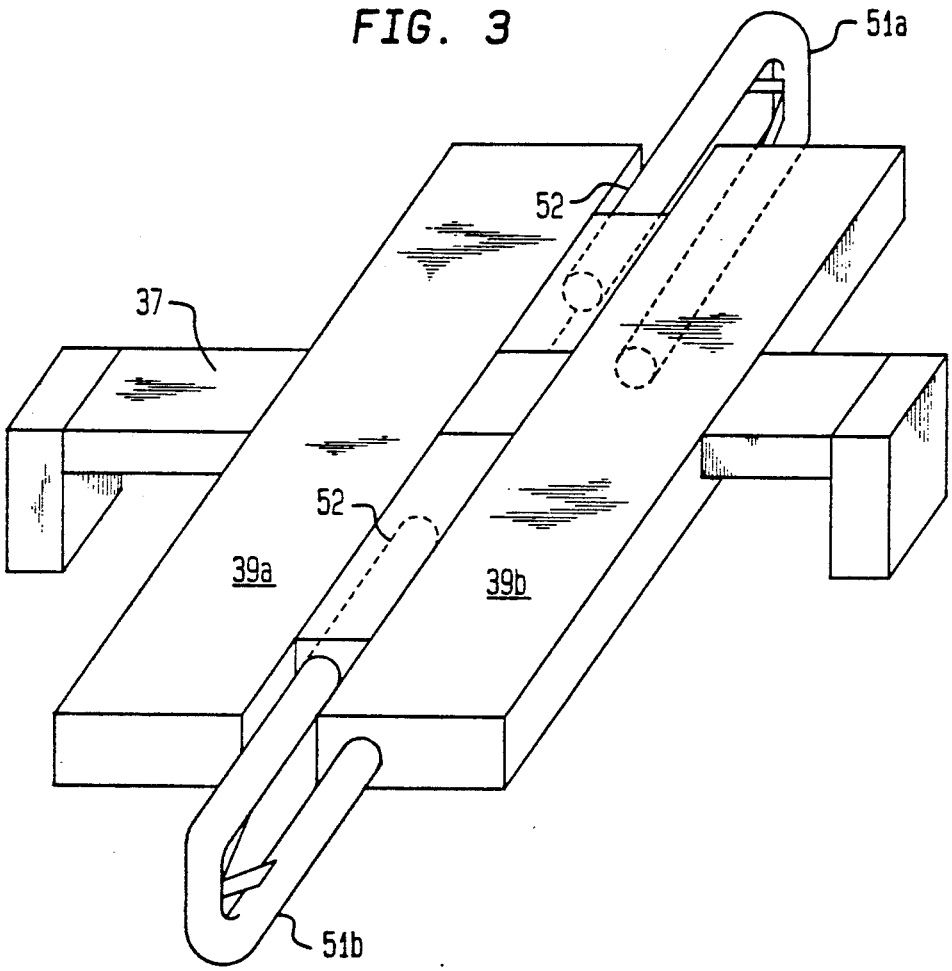
FIG. 3 shows a detailed perspective view of the tunnel hanger.

Two separate bag hangers are provided in this embodiment for enabling a bulk bag to be hung from the cross-beam 37. Mounted on the tine channel 39 are a plurality of strap hooks 38 over which may be looped the commonly provided corner slings of a bulk bag. Also provided is a slideably adjustable center pick-up bracket 51 which is mounted between rectangular tubes 39*a* and 39*b*. As shown in more detail in FIG. 3, the bracket 51 comprises two U-shaped tubes 51*a* and 51*b* which are slideably inserted through a tube 52 mounted on the cross-beam 37. Each of the tubes 51*a* and 51*b* may thus be inserted through the commonly provided fabric tunnel of a bulk bag. Either type of bag hanger thus enables the bulk-bag to be raised in tandem with the cross-beam 37.

Also mounted on vertical support beams 31*a* and 31*b* are winches 40*a* and 40*b*, respectively. Winches 40*a* and 40*b* are preferably electrically operated with power coming from an external source through a common electrical cord (not shown). Push buttons 41*a* and 41*b* are used to actuate winches 40*a* and 40*b*, respectively, in either forward or reverse directions. The winches are designed to remain locked in position when not being actuated.

The method of operating the apparatus in accordance with the present invention is as follows. The apparatus 20 with the cross-beam 37 in its lower fixed position is first maneuvered so that a free-standing bulk bag is contained within the bag frame 22. Next, the hanging devices of the bulk bag, either corner slings or a fabric tunnel, are engaged by the bag hanger. In the case of a bulk bag having corner slings, the slings are simply looped over the strap hooks 38. If the bag has a fabric tunnel on its top surface, the center pick-up bracket tubes are inserted therethrough. In either case, the lower fixed position of the cross-beam 37 is such that the task may be easily accomplished by a single person.

Either a hoist or a forklift machine can be used to lift the apparatus with the bulk bag hanging therefrom and carry the bag to the desired discharge location. If a fork lift is used, the forklift is maneuvered such that its tines are inserted through the tine channel 39, thus enabling the forklift to raise the cross-beam 37. After the cross-beam 37 is raised to its upper limit of upward travel-by reaching mechanical stops 33, the entire apparatus may be lifted and carried by the forklift to the discharge container. The bag can then be discharged in the manner described below while the apparatus is supported by the forklift with the bulk bag positioned directly over the discharge container.

Figure 4:
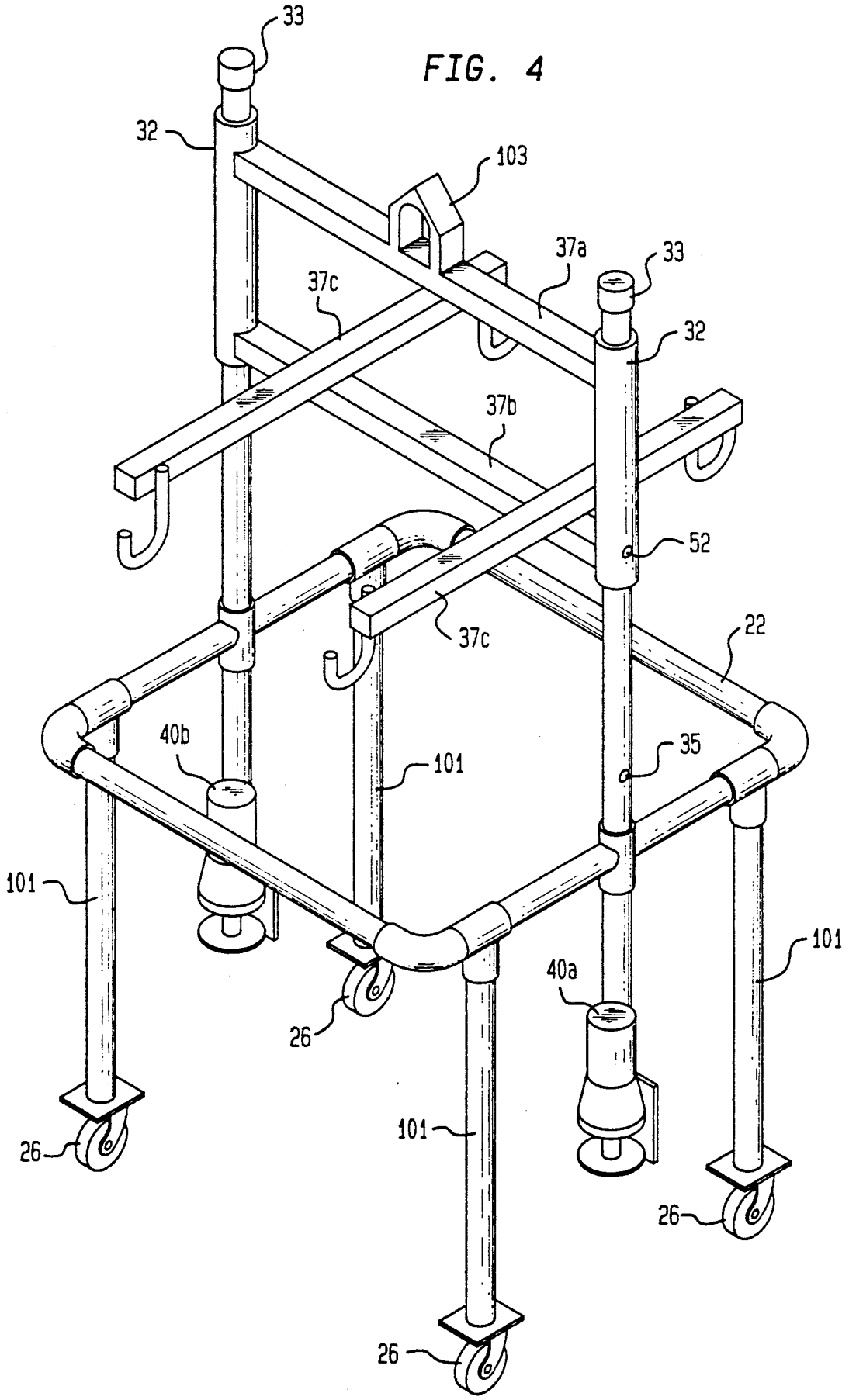
FIG. 4 shows a perspective view of a second embodiment of the present invention.

FIG. 4 shows a perspective view of a second embodiment of the present invention which is similar in all significant respects to the first embodiment except for the following features. In this embodiment, the base frame 22 is mounted on casters 26 by means of vertically extending legs 101. The legs 101 elevate the base frame 22 to a sufficient height that it will clear the top of a free-standing bulk bag as the apparatus is maneuvered over the bag. Thus, it is not necessary for the base frame 22 to have an open front in this embodiment. There is also no need for the push handle 43.

The second embodiment shown in FIG. 4 has a tine channel formed by upper and lower cross-beams 37*a* and 37*b*. The bag hangers 38 are mounted on transverse beams 37*c* of lower cross-beam 37*b*. The very wide tine channel facilitates the positioning of the fork lift tines within. Owing to the flat bottom surface of the upper cross-beam 37*a*, the apparatus may rest stably on the fork lift tines. Alternatively, of course, the tine channel may be eliminated entirely by providing only one cross-beam with a flat bottomed surface for contacting the fork lift tines with the bag hangers 38 mounted on the single cross-beam.

Also shown in FIG. 4 is a hoist loop 103 mounted on the upper cross-beam 37*a* through which may be inserted the hook of a cable or chain hoist. A movable hoist can thus be used in place of a fork lift for lifting and moving the apparatus.

Figure 5:
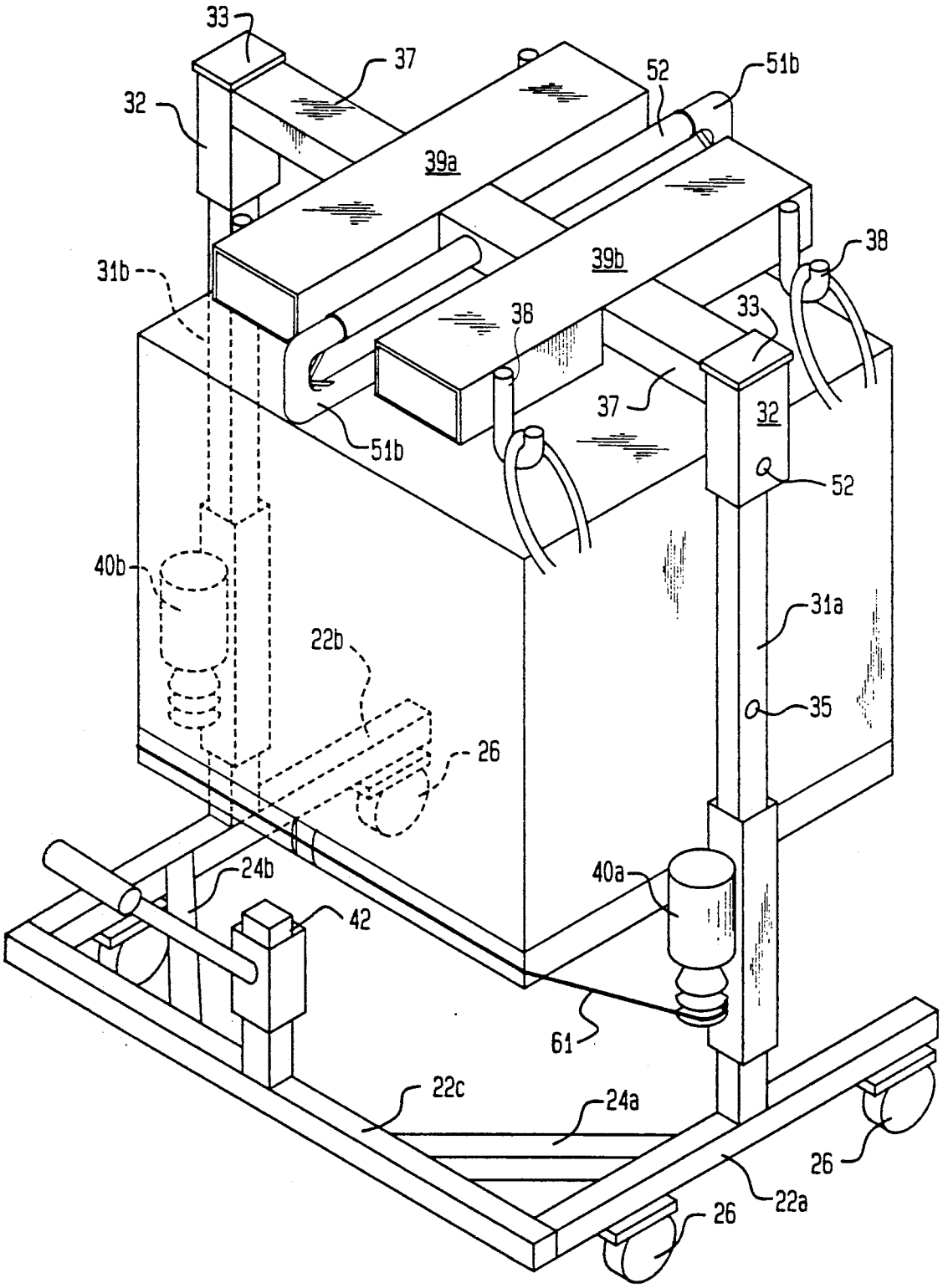
FIG. 5 shows the bag handling and discharging apparatus with bulk bag hanging therefrom by its corner slings

FIG. 5 shows a bulk bag hanging by its corner slings from the strap hooks 38 of the first embodiment of apparatus. Before the bottom of the bag is opened to discharge its contents, a winch cable or rope 61 is looped around so as to girth the lower circumference of the bag with each free end of the cable then being attached to one of winches 40*a* or 40*b* as shown in FIG. 4. By actuating the winches so as to pull the cable 61 in opposition to each other, the lower portion of the bag is cinched by the cable. An opening can now be created by any appropriate means in the bottom of the bag to discharge the bag contents. The rate of discharge from the bag is controlled by the degree of cinching. An operator may operate the winches intermittently to either speed up or slow down the rate of discharge. After the desired amount of contents has been discharged from the bag, the winches are operated so as to cinch the bag tightly and close off the bottom opening. At this point, the forklift may carry the apparatus to another discharge container for further emptying of the contents. Alternatively, the apparatus may be carried to a temporary storage location with the sealed bag hanging therefrom. By first locking the cross-beam 37 in its upper fixed position, the apparatus may be lowered to the floor with the bag hanging from the cross-beam 37 and cinched closed by winch cable 61.

Figure 6:
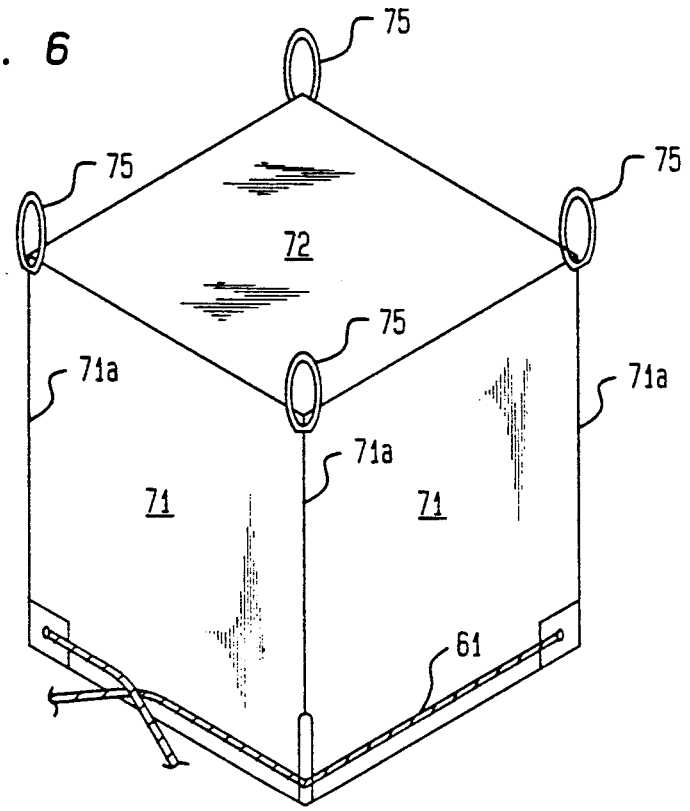
FIG. 6 shows a bulk bag with a winch cable loop around its lower circumference and threaded through grommets within sewn on corners of fabric.
Figure 7:
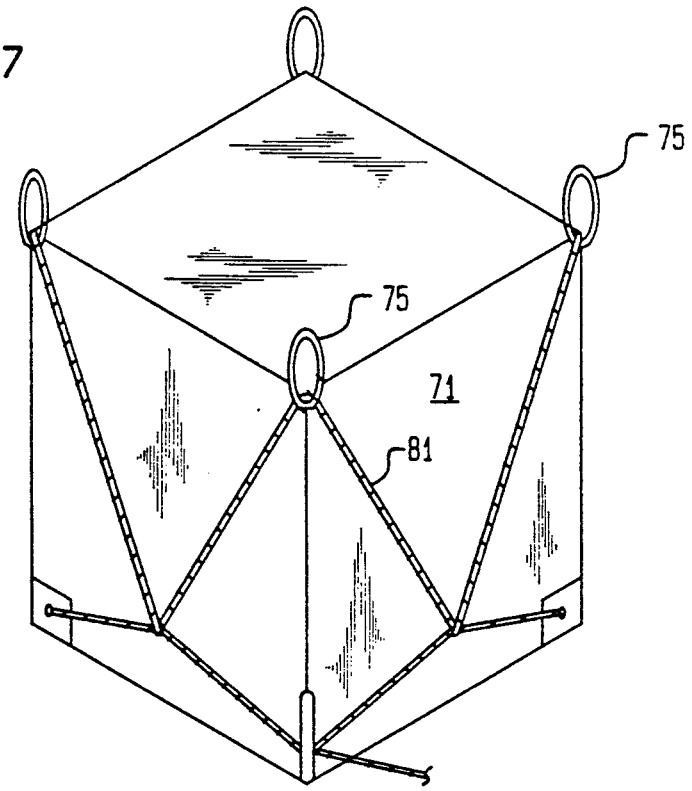
FIG. 7 shows the same bag as in FIG. 5 but with an additional support cable supporting the upper sidewalls of the bag.
Figure 8:
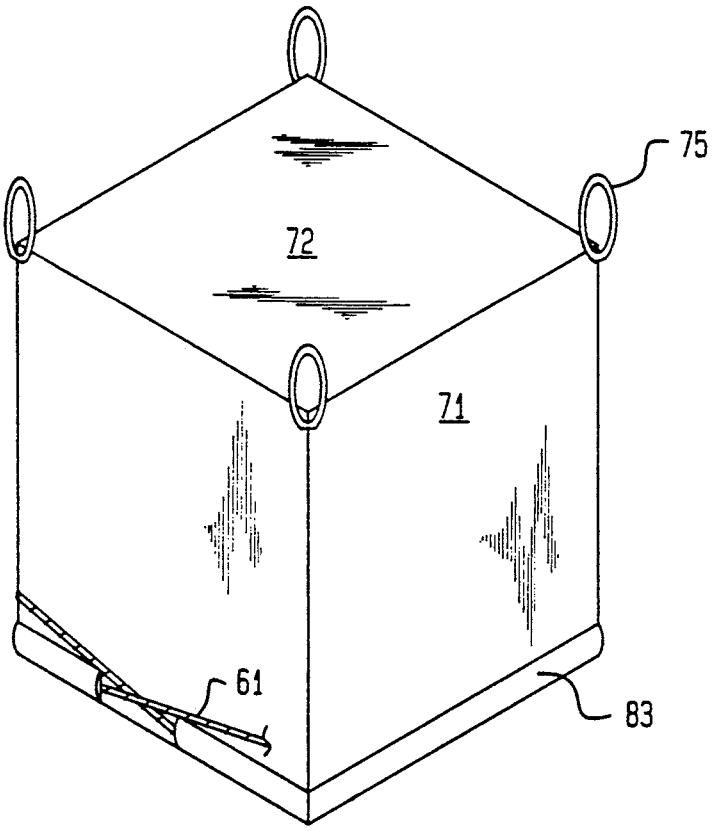
FIG. 8 shows a bulk bag with a fabric sleeve around its lower circumference having two adjacent openings to allow the winch cable to be threaded therethrough.

FIGS. 6, 7, and 8 show bulk bags in accordance with the present invention which are designed to facilitate the cinching process described above using a winch cable 61 looped around the bag's lower circumference. If no means are employed to maintain the cable 61 in fixed position to the side walls of the bag, as the bag is cinched by the cable the lower portion of the bag tends to be pulled upward. This is due to the bag contents located above and lateral to the cable loop being pulled downward by its own weight which then tends to pull the portion of the bag below the cable loop upward and out of the loop. As soon as a portion of the opened bottom surface of the bag is pulled up and out of the cable loop, further discharge of the bag contents cannot be controlled. It is thus desirable, especially in the case of very dense bag contents, to use bulk bags which have a means for either securing the winch cable looped around the lower portion of the bag in fixed position to the bag sidewalls or for supporting the upper sidewalls of the bag.

FIG. 6 shows a bulk bag with four sidewalls 71 joined at four side seams 71*a*, with the sidewalls being further joined to the top wall 72 and a bottom wall (not shown) to form a bag of generally cubical shape. At the upper four corners of the bag are corner slings 75. An alternate embodiment of the bag could have a fabric tunnel. At each of the four lower corners of the bag is a fabric corner sewn thereto having a grommet within. The winch cable may thus be threaded through each grommet as it is looped around the bag's lower circumference. Alternatively, loops of fabric sewn around the bag's lower circumference could be used instead of grommets.

FIG. 7 shows the same bag as in FIG. 6 but with a support cable 81 which is threaded through the corner slings 75 and also passed around the winch cable 61 on each side of the bag. The ends of the support cable 81 are then secured together (not shown) so that the support cable 81 traverses the lateral sidewalls of the bag during the cinching process and thereby supports the portion of the bag and bag contents above and lateral to the winch cable loop. The support cable method is shown here as being used in conjunction with sewn on grommets to secure the winch cable. However, if the bag contents are not too dense, it is possible to use only the support cable 81 with an ordinary bulk bag.

FIG. 8 shows a bulk bag similar to that of FIG. 6 but with no sewn-on grommets. Instead, there is provided a sleeve 83 which partially surrounds the lower portion of the bag and has two adjacent openings for allowing the winch cable to be threaded therethrough. In this preferred embodiment, the winch cable is fixed in position to all portions of the bag sidewalls. Thus the only way the lower portion of the bag could be pulled up and out of the winch cable loop during the cinching process would be if the structural integrity of the sleeve were compromised.

Although the invention has been described in conjunction with the foregoing specific embodiment, many alternatives, variations, and modifications will be apparent to those of ordinary skill in the art. Those alternatives, variations, and modifications are intended to fall within the scope of the following appended claims.

What is claimed is:

1. A bulk bag handling and discharging apparatus to be used in conjunction with an external hoist means having at least one tyne, comprising:

a generally horizontally-oriented base frame mounted on casters;

a vertically-oriented support frame rigidly connected to the base frame;

a cross-beam slideably mounted on the vertical support frame for vertical movement between an upper fixed position and a lower fixed position;

a mechanical stop at the upper end of the vertical support frame which limits the upward travel of the cross-beam, thereby enabling the entire apparatus to be lifted by a vertical force applied to the cross-beam by said hoist means;

means for locking the cross-beam in both said upper and lower fixed positions, the locking means preventing further vertical travel of the cross-beam with respect to said vertical support frame from the upper and lower fixed positions;

a bag hanger mounted on the cross-beam upon which may be hung a bulk bag; and receiving means including the cross-beam for receiving the tynes of said hoist means.

2. The apparatus as set forth in claim 1 wherein the base frame is mounted on the casters by means of a plurality of vertically extending legs which elevate the base frame to a height sufficient to clear the top of a free-standing bulk bag.

3. The apparatus as set forth in claim 1 wherein the base frame has an open front for allowing a free-standing bulk bag to pass through.

4. The apparatus as set forth in claim 1 further comprising a hoist loop mounted on the cross-beam.

5. The apparatus as set forth in claim 1 wherein the bottom surface of the cross-beam is flat.

6. The apparatus as set forth in claim 1 wherein the bag hanger comprises a plurality of strap hooks over which may be looped corner slings of a bulk bag.

7. The apparatus as set forth in claim 1 wherein the bag hanger comprises a slideably adjustable center pick-up bracket for inserting through a fabric tunnel located on the top wall of a bulk bag.

8. The apparatus as set forth in claim 1 further comprising a pair of winches mounted on the apparatus in a manner enabling both winches to pull in opposition to each other a winch cable girthing a bulk bag hanging from the cross-beam when the cross-beam is locked in the upper fixed position.

9. The apparatus as set forth in claim 3 wherein the vertical support frame comprises a pair of vertical support beams mounted on each side of the base frame, the cross-beam being slideably mounted at each end on the vertical support beams.

10. The apparatus as set forth in claim 9 wherein a winch is mounted on each of the vertical support beams.

11. The apparatus as set forth in claim 9 wherein the cross-beam is slideably mounted on the vertical support beams by means of sleeves attached to each end of the cross-beam which engage the vertical support beams.

12. The apparatus as set forth in claim 11 wherein the means for locking the cross-beam in upper and lower fixed positions comprises lock pins insertable through holes in the vertical support beams and the sleeves, the holes in the sleeves being aligned with the holes in the vertical support beams when the cross-beam is in either the upper or lower fixed position.

13. The apparatus as set forth in claim 6 wherein the mechanical stop means limiting the upward travel of the cross-beam comprises flanged upper ends of the vertical support beams which limit the upward travel of the sleeves.

14. The apparatus as set forth in claim 1 wherein the base frame comprises two side base beams rigidly connected to the ends of a front base beam and oriented perpendicularly thereto.

15. The apparatus as set forth in claim 1, whereby said receiving means is a tyne channel.

* * * * *